US009907724B2

(12) United States Patent
Mercado Diaz

(10) Patent No.: US 9,907,724 B2
(45) Date of Patent: Mar. 6, 2018

(54) PENIS ENHANCEMENT AND MASSAGE DEVICE AND METHOD

(71) Applicant: Jesus Manuel Mercado Diaz, Miami Beach, FL (US)

(72) Inventor: Jesus Manuel Mercado Diaz, Miami Beach, FL (US)

( * ) Notice: Subject to any disclaimer, the term of this patent is extended or adjusted under 35 U.S.C. 154(b) by 407 days.

(21) Appl. No.: 14/803,268

(22) Filed: Jul. 20, 2015

(65) Prior Publication Data

US 2016/0015594 A1 Jan. 21, 2016

Related U.S. Application Data

(60) Provisional application No. 62/026,144, filed on Jul. 18, 2014.

(51) Int. Cl.
*A61H 19/00* (2006.01)

(52) U.S. Cl.
CPC ..... *A61H 19/32* (2013.01); *A61H 2201/0153* (2013.01); *A61H 2201/1253* (2013.01)

(58) Field of Classification Search
CPC ..... A61H 19/32; A61H 2201/0153; A61H 2201/1253
See application file for complete search history.

(56) References Cited

U.S. PATENT DOCUMENTS

2007/0282163 A1* 12/2007 Williams ..... A61F 5/41 600/41
2015/0245979 A1* 9/2015 Knyrim ..... A61H 23/0263 600/38
2016/0000642 A1* 1/2016 Zipper ..... A61H 19/34 600/38
2016/0324718 A1* 11/2016 Zamar ..... A61H 19/32

* cited by examiner

*Primary Examiner* — Glenn Richman
(74) *Attorney, Agent, or Firm* — Nancy J. Flint

(57) ABSTRACT

A device that stimulates and aids penis jelqing, or penis milking massage, is disclosed. The device enhances the jelq exercise because it comprises an ergonomic shape that holds and keeps the penis in position by gripping it around the base and squeezing it to make a stroking jelqing motion.

7 Claims, 7 Drawing Sheets

PENIS ENHANCEMENT AND MASSAGE DEVICE AND METHOD

FIELD OF THE INVENTION

The invention relates to the field of penis enhancement. More particularly, the invention relates to penis enhancement devices and methods of penis enhancement. A device that stimulates and aids penis jelqing, or penis milking massage, is disclosed. The device enhances the jelq exercise because it comprises an ergonomic shape that holds and keeps the penis in position by gripping it around the base and squeezing it to make a stroking jelqing motion.

BACKGROUND OF THE INVENTION

Many men do not feel confident with the size of their penis. To resolve this and others issues, such as erections and premature ejaculation, men often use a series of manual massage exercises. Penis jelging is a well-known such exercise that involves stroking, pulling, and twisting motions applied to a semi-flaccid penis. By performing these motions, more blood is forced into the chambers of the penis. Exercise practitioners attempt, through numerous repetitions, to maximize penis size by causing the cells of the erectile tissue to expand by forcing more blood into them.

When performing the manual exercise, the base of the penis must be held by one hand while stroking the penis with the other hand. However, manual exercises tend to cause pain and tiredness in the hands; therefore, it can be difficult to perform the number of repetitions necessary to achieve results. To resolve this additional issue, men have created homemade jelq tools to facilitate this exercise. Homemade versions, most of them made using jar lifters, do not keep the penis in position, causing the penis to slip out of the device.

Homemade versions are designed to hold the penis from the front, making contact only with the top and underside of the penis. These homemade versions do not have a mechanical system that holds the penis in position while performing the jelq exercise, consequently, the penis slip out of the device. Additional, homemade versions do not exert a uniform pressure force while performing massage.

SUMMARY OF THE INVENTION

The invention provides a device that stimulates and aids penis jelqing, or penis milking massage. The invention enhances the jelq exercise because it comprises an ergonomic shape that holds and keeps the penis in position by gripping it around the base and squeezing it to make a stroking jelqing motion.

The device according to one embodiment of the invention comprises a first arm attached by a pin to a second arm that allows the device to open and close in a scissor-like manner. The first arm comprises a handle cavity for holding the device with the user's hand, and the second arm comprises a fingers cavity so that the user can comfortably hold the device with the other hand. The inner edges of both arms comprise a medical silicone units having a curved shaped so that when the device is in a closed position, the two arms create an oval-shaped cavity between the medical silicone units which supports and holds the base of the penis.

When the penis is placed between the two medical silicone units, the user can perform the jelqing stroking motion by closing the arms until the desired pressure is reached. A stroking and pulling motion is performed along the entire length of the penis from its base to its head.

In one embodiment of the invention, the medical silicone units can be removed and replaced by new ones by removing back segments of the two arms that are attached from the back of the device with screws. Different shapes for the medical silicone units may be added to give some variation in the stroking sensation.

DETAILED DESCRIPTION OF THE INVENTION

The invention provides a device that stimulates and aids penis jelqing, or penis milking massage.

The device according to one embodiment of the invention comprises a first arm attached by a pin to a second arm that allows the device to open and close in a scissor-like manner. The first harm comprises a handle cavity for holding the device with the user's hand, and the second arm comprises a fingers cavity so that the user can comfortably hold the device with the other hand. The inner edges of both arms comprise a medical silicone unit having a curved shaped so that when the device is in a closed position, the two arms create an oval-shaped cavity between the medical silicone units which supports and holds the base of the penis.

To perform the jelqing exercise, the user should open the arms to place the penis on one of the silicone medical units. Then, the user squeezes the base of the penis between the two medical silicone units by closing the two arms until the desired pressure is reached. A stroking and pulling motion is performed along the entire length of the penis from its base to its head. The pressure of the massage using the device is more uniform than homemade versions of jelqing devices due to the support of the penis between the medical silicone units.

In one embodiment of the invention, the medical silicone units can be removed and replaced by new ones by removing back segments of the two arms that are attached from the back of the device with screws. Different shapes for the medical- silicone units may be added to give variation in the stroking sensation.

Figure 1:
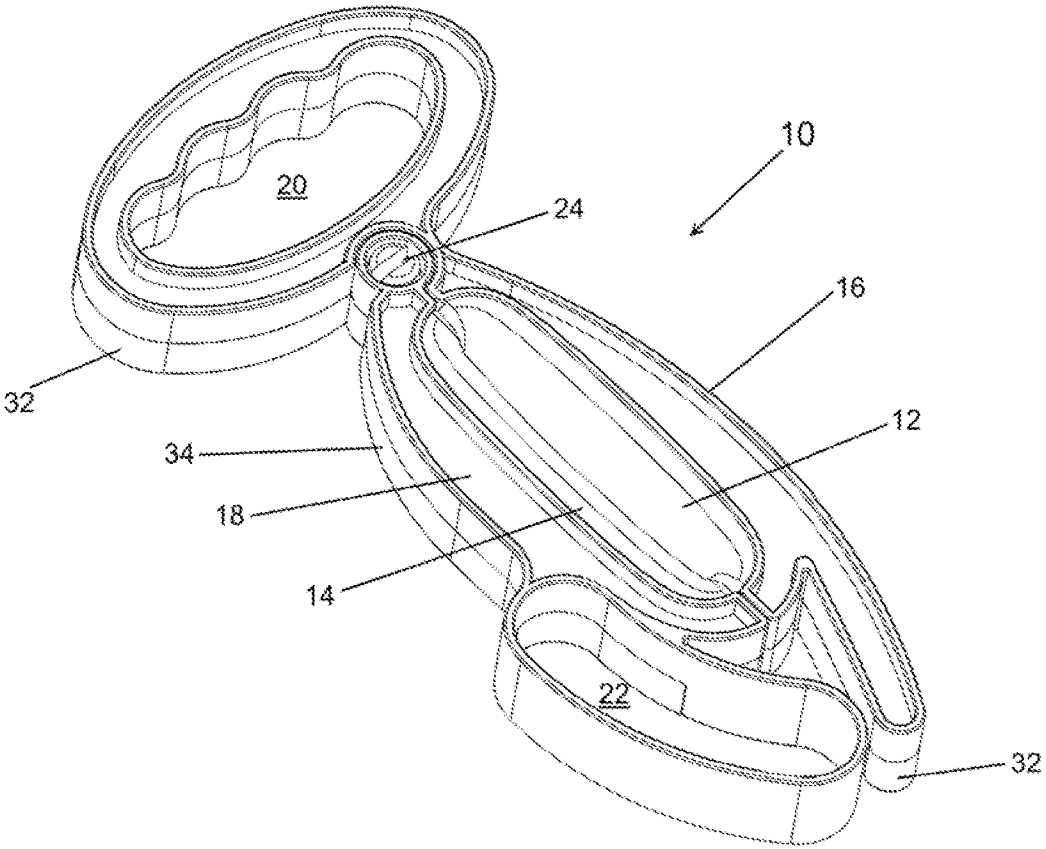
FIG. 1 is a front perspective view of the penis enhancement and massage device according to one embodiment of the invention.

Turning to the drawings, FIG. 1 depicts a front perspective view of a penis enhancement and massage device 10 in a closed position according to one embodiment of the invention comprising a first arm 16 and a second arm 18. First arm 16 comprises first medical silicone unit 12 and first arm back segment 32. Second arm 18 comprises second medical silicone unit 14 and second arm back segment 34. First and second medical silicone units 12 and 14 are placed in the penis enhancement and massage device 10 by a locked in mechanism between the first arm 16 and second arm 18 and first arm back segment 32 and second arm back segment 34 respectively, explained further in FIG. 6.

As shown in FIG. 1, first arm 16 comprises a handle cavity 20 sufficiently wide and long enough to accommodate the hand of the user. In one embodiment, cavity 20 is about 2.5 inches deep and 3.75 inches wide. Second arm 18 comprises a finger cavity 22 sufficiently wide and long to comfortably accommodate up to four fingers of one hand of the user. In one embodiment, finger cavity 22 is about 3.5 inches wide and 1 inch deep.

Figure 2:
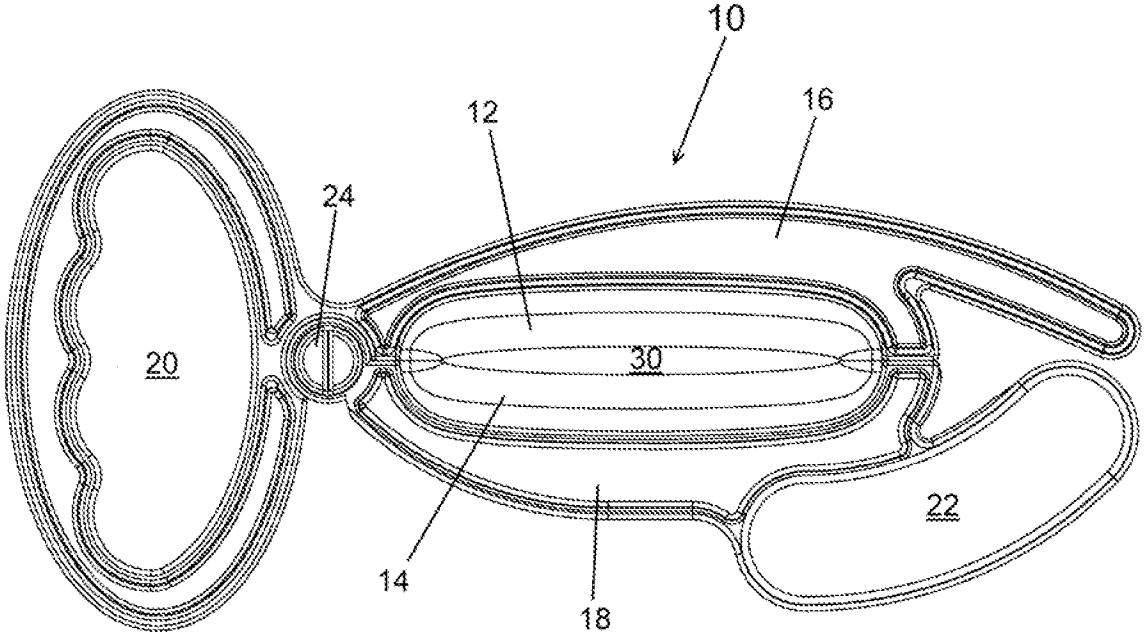
FIG. 2 is a front view of the penis enhancement and massage device according to one embodiment of the invention.

FIG. 2 depicts a front view of the penis enhancement and massage device 10 in its closed position. First and second medical silicone units 12 and 14 each comprise a curved shaped on the side distal from first arm 16 and second arm 18. The curved shapes of first and second silicone medical units 12 and 14 create an inner cavity 30 when the penis enhancement and massage device 10 is in the closed position. Inner cavity 30 maintains the penis for massage. In one embodiment, cavity 30 is substantially an oval shape. In one embodiment, the inner diameter of cavity 30 is about ¼ inch and 3.5 inches of length. In further detail, FIG. 2 shows the handle cavity 20 and the finger cavity 22.

Referring again to FIG. 1 and FIG. 2, first arm 16 and first arm 18 are connected with pin 24. FIG. 1 depicts first arm 16 along with first arm back segment 32; and second arm 18 along with second arm back segment 34 attached by pin 24 to assemble the penis enhancement and massage device 10.

Figure 3:
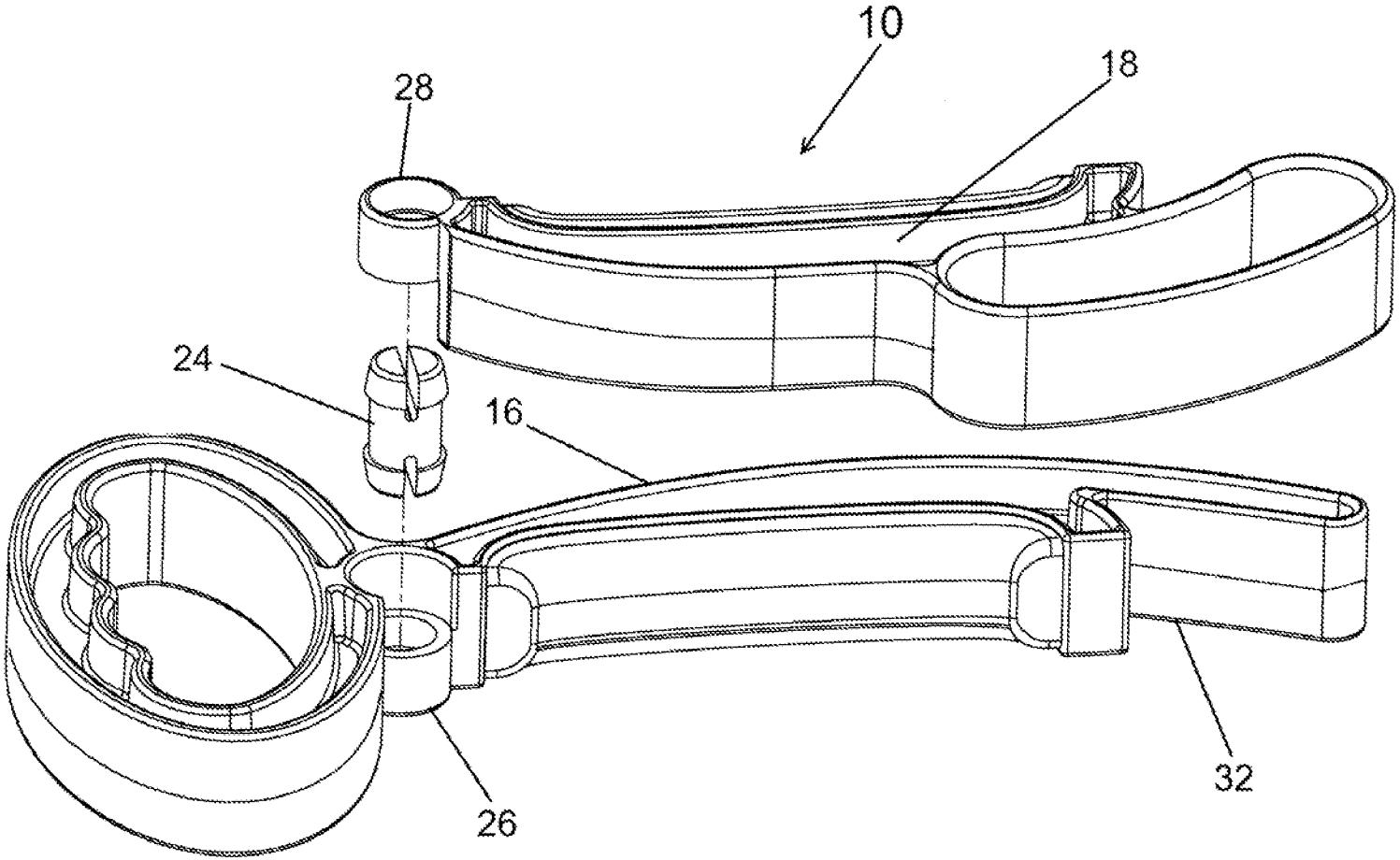
FIG. 3 is a front perspective view and an exploded view of the penis enhancement and massage device according to FIG. 1, showing assembly of the device.

FIG. 3 depicts an exploded view of penis enhancement and massage device 10 showing assembly of first arm 16 and second arm 18 by pin 24. Referring further to FIG. 3, first arm back segment 32 and second arm 18 comprise pin holes 26 and 28, respectively, that receives a pin 24.

Figure 4:
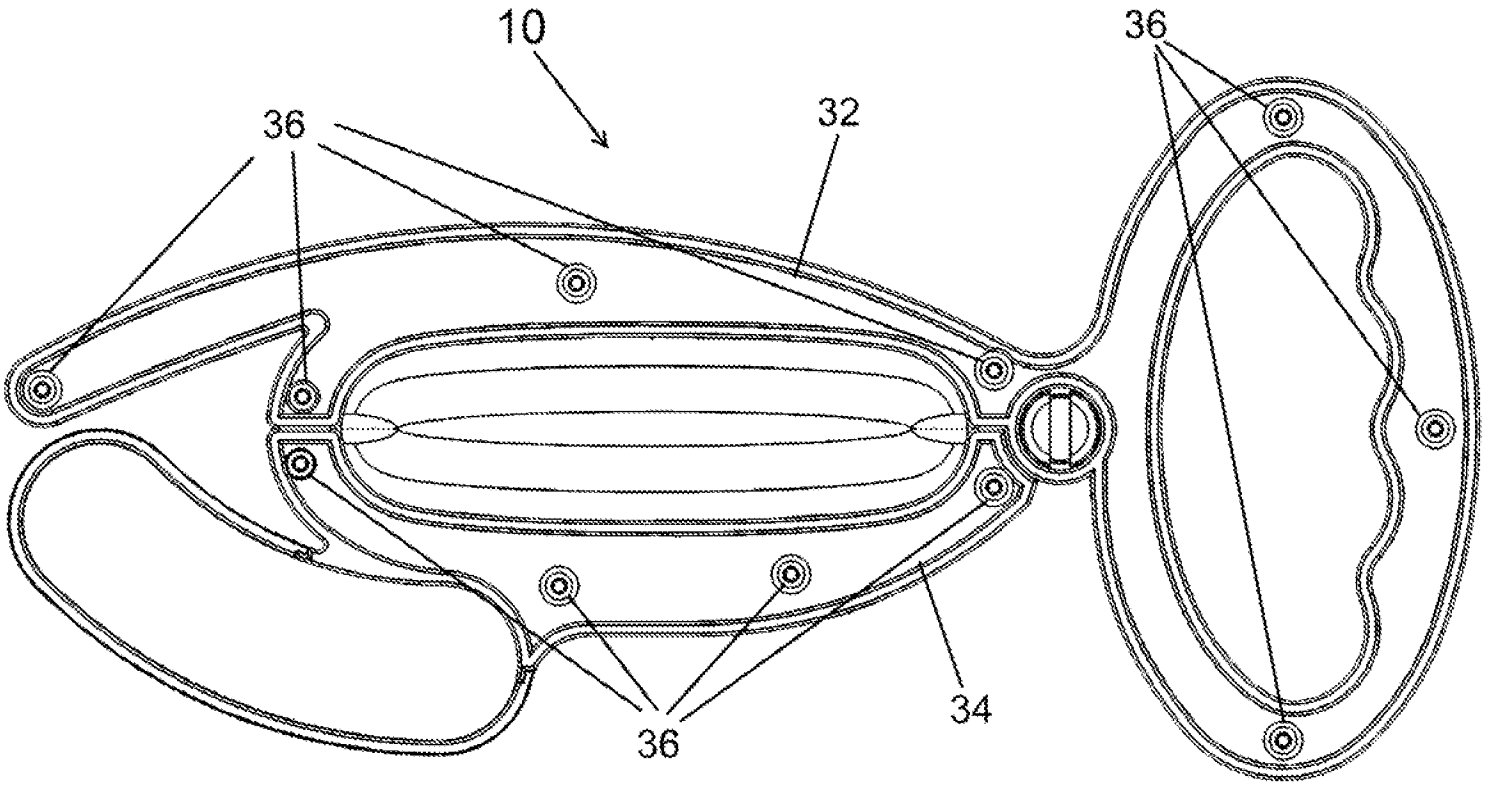
FIG. 4 is a back view of the penis enhancement and massage device of FIG. 1.

FIG. 4 depicts a back view of penis enhancement and massage device 10 of FIG. 1. First arm back segment 32 and second arm back segment 34 are attached by screws 36 to first arm 16 and second arm 18 respectively, previously shown in FIG. 1 and FIG. 2. First arm back segment 32 and second arm back segment 34 can be removed by unscrewing screws 36.

Figure 5:
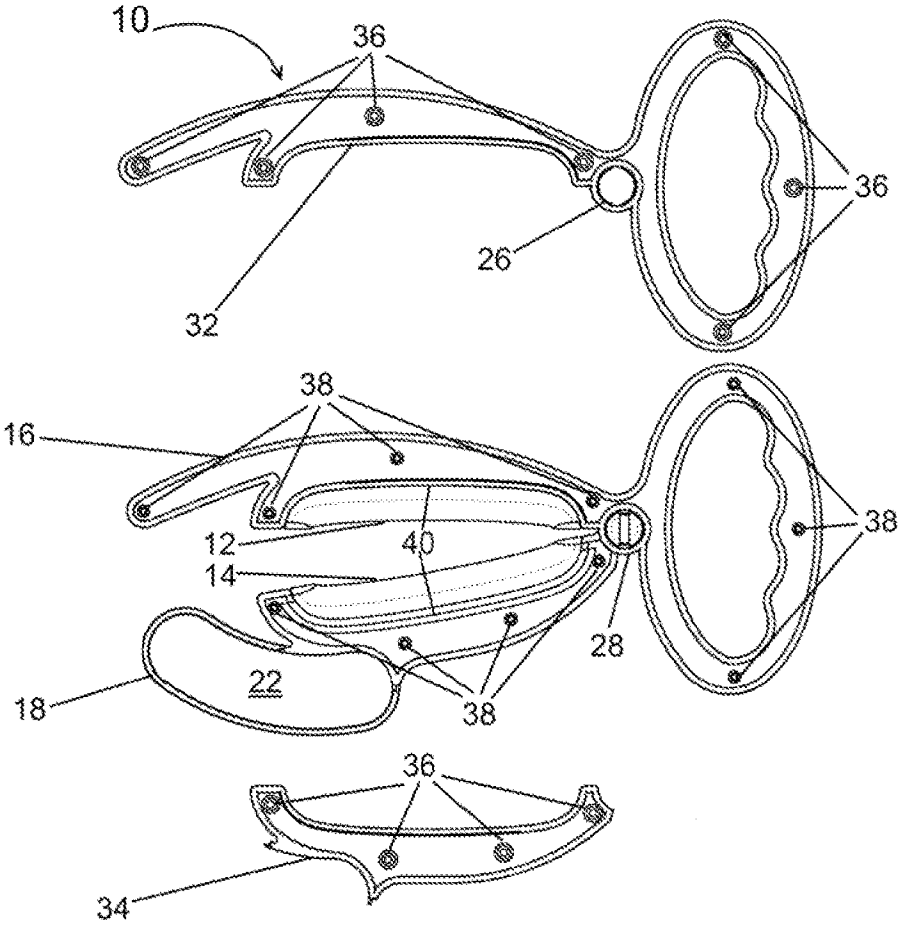
FIG. 5 is a back and an exploded view of the penis enhancement and massage device of FIG. 1, showing separate parts.

FIG. 5 depicts a back exploded view of the penis enhancement and massage device of FIG. 1, showing first arm back segment 32 and second arm back segment 34 removed from first arm 16 and second arm 18. First back segment 32 corresponds in size and shape to first arm 16 except that it lacks a corresponding cavity to pin hole 26. Second back segment 34 corresponds partially in size and shape to second arm 18, except that second back segment 34 does not include a corresponding segment to finger hole 22 and pin hole 28. First arm 16 and second arm 18 comprise threaded cavities 38 on the inner side for accepting screws 36. First and second medical silicone units 12 and 14 can be removed for cleaning or replacement by separating first arm 16 from first arm back segment 32 and second arm 18 from second arm back segment 34 respectively. Each medical silicone unit 12 and 14 comprises a groove 40 on the inner side proximal the first arm 16 and second arm 18, not shown when the penis enhancement and massage device 10 is assembled, that mates with a lip on the inner edges of the arms 16, 18, not shown in the figure, to hold the medical silicone units 12, 14 in position once reassembled.

Figure 6:
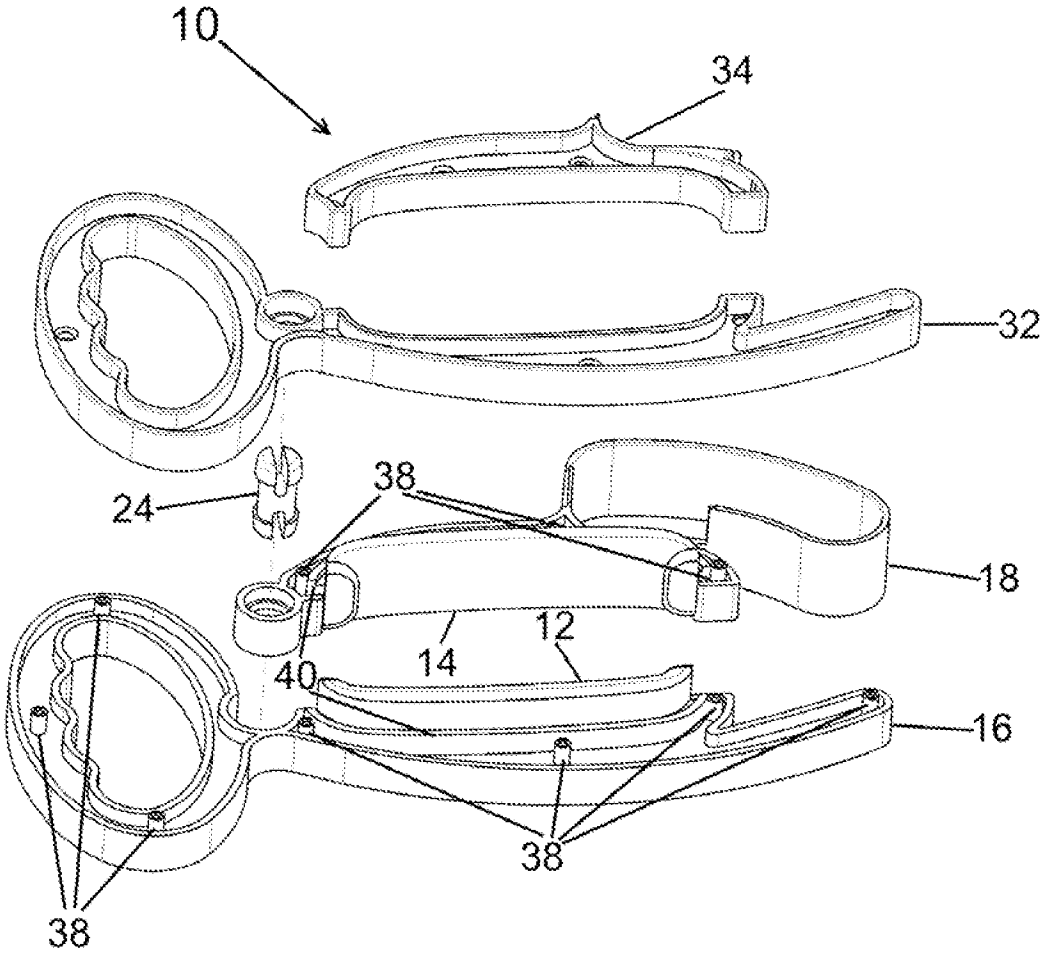
FIG. 6 is a back perspective view and an exploded view of the penis enhancement and massage device of FIG. 1, showing assembly of device parts.

FIG. 6 depicts a back perspective view and an exploded view of the penis enhancement and massage device 10 of FIG. 1, showing assembly of device parts and separate components; first arm 16, second arm 18, first arm back segment 32, second back segment 34 and pin 24. In more detail FIG. 6 shows groove 40 of the first and second medical silicone units 12 and 14 and the threaded cavities 38 of first arm 16 and second arm 18.

Figure 7:
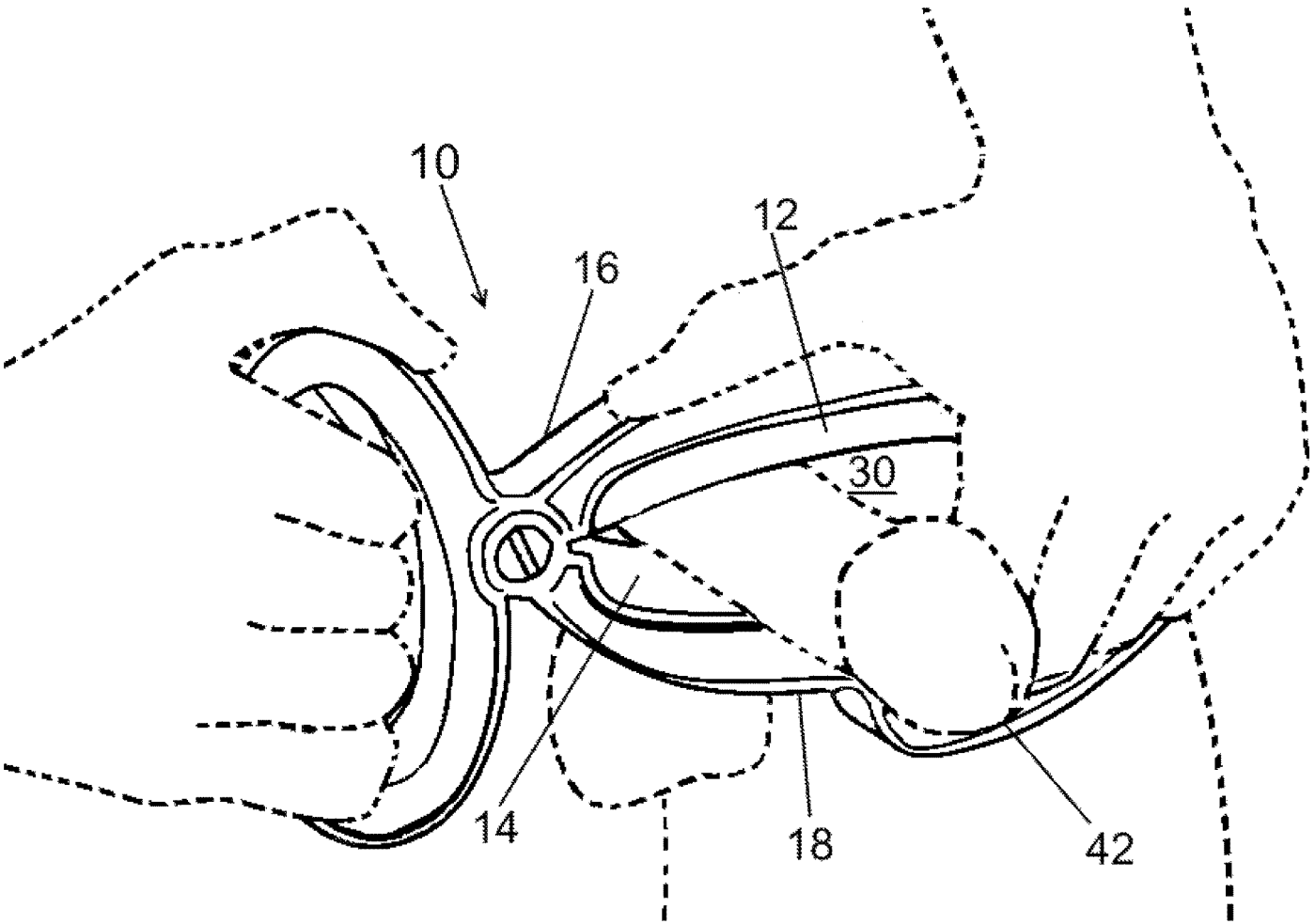
FIG. 7 shows the device according to FIG. 1 with its position mounted on the penis and being used by a consumer.

Referring now to FIG. 7, the penis enhancement and massage device 10 is shown in position mounted on a penis as used by a user to perform the jelqing exercise. After the penis has been placed on one of first or second medical silicone units 12, 14, the user closes first arm 16 and second arm 18 in a scissors like movement such that the penis is enclosed inside the oval cavity 30 formed between first and second medical silicone units 12, 14. The user repeatedly exerts pressure to close first arm 16 and second arm 18, then releases the pressure as well as moves the device up and down the length of the penis to perform the jelq massage.

The penis enhancement and massage device 10 may be made of plastic or any other sufficiently rigid and strong material. Medical-grade silicone, an hypoallergenic material, is desired for use in medical silicone units 12 and 14 since they have contact with the skin of the penis.

The advantages of the invention include, without limitation, that it keeps the penis in position and massages the penis evenly by putting the device between two medical silicone units, and closing the device around the penis until the penis body fills a small oval-shaped cavity and adjusts to fill that space.

While the written description above of the invention enables one of ordinary skill to make and use what is presently considered to be the best mode thereof, those of ordinary skill will understand and appreciate the existence of variations, combinations, and equivalents of the specific embodiment, method, and examples herein. The invention should therefore not be limited by the above described embodiment, method, and examples but by all embodiments and methods within the scope and spirit of the invention.

The invention claimed is:

1. A penis enhancement and massage device comprising:

a first arm comprising:

a handle cavity;

a first arm back first segment comprising a pin hole; and a first medical silicone unit;

a second arm comprising:

a pin hole;

a finger cavity;

a second medical silicone unit; and a second arm back segment; and a pin, wherein the device is connected by inserting the pin through the first pinhole cavity and the second pinhole such that the first arm and second arm rotate in a scissors-like motion between an open position and a closed position, wherein the first arm comprises an outer edge distal from the second arm and an inner edge proximal to the second arm, wherein the first medical silicone unit is attached to the inner edge of the first arm;

wherein the second arm comprises an outer edge distal from the second arm and an inner edge proximal to the first arm, wherein the second medical silicone unit is attached to the inner edge of the second arm;

wherein the first medical silicone unit and the second medical unit each comprise a curved shaped such that when device is in the closed position, the first arm and attached first medical silicone unit and the second arm and second silicone medical unit create a cavity.

2. The device of claim 1, wherein the first arm and the first arm back segment are attached with screws.

3. The device of claim 1, wherein the second arm and the second arm back segment are attached with screws.

4. The device of claim 1, wherein the finger cavity is about 3.5 inches wide and 1 inch deep.

5. The device of claim 1, wherein the handle cavity is about 2.5 inches deep and 3.75 inches wide.

6. The device of claim 1, wherein the cavity formed between the first medical silicone unit and the second medical unit is about ¼ inch wide and 3.5 inches in length.

7. A method of performing penis enhancement and massage, comprising:

placing a penis between medical silicone units of a penis enhancement and massage device;

closing the device on the penis until the pressure on the penis as desired by the user of the device is reached; and massaging the penis, wherein the penis enhancement and massage device comprises the device of claim 1.

* * * * *